United States Patent [19]

Wulf

[11] 4,095,575

[45] Jun. 20, 1978

[54] INTERNAL COMBUSTION ENGINE

[75] Inventor: Leitermann Wulf, Bad Wimpfen, Germany

[73] Assignee: Audi NSU Auto Union Aktiengesellschaft, Germany

[21] Appl. No.: 701,179

[22] Filed: Jun. 30, 1976

[30] Foreign Application Priority Data

Jul. 2, 1975 Germany ..... 2529376

[51] Int. Cl.[2] ..... F02M 31/00; F02M 17/00

[52] U.S. Cl. ..... 123/142.5 R; 165/51

[58] Field of Search ..... 123/142.5 R, 122 R; 165/51

[56] References Cited

U.S. PATENT DOCUMENTS

| | | | |
|---|---|---|---|
| 1,168,623 | 1/1916 | Furber | 123/142.5 |
| 1,783,289 | 12/1930 | Hopkins | 123/142.5 |
| 1,885,225 | 11/1932 | Bordeaux | 123/142.5 |
| 1,985,636 | 12/1934 | Foss | 123/142.5 |

*Primary Examiner*—Ronald H. Lazarus

*Attorney, Agent, or Firm*—Kane, Dalsimer, Kane, Sullivan and Kurucz

[57] ABSTRACT

An internal combustion engine is provided with a liquid circuit in which, until a predetermined temperature is reached, a thermostat causes the liquid to pass through a heat exchanger acted on by hot exhaust gases. Such devices can be used both for warming up the liquid in the coolant circuit of an engine in order to obtain rapid warming-up of the engine, and also for heating a liquid provided for heating the engine induction system.

2 Claims, 1 Drawing Figure

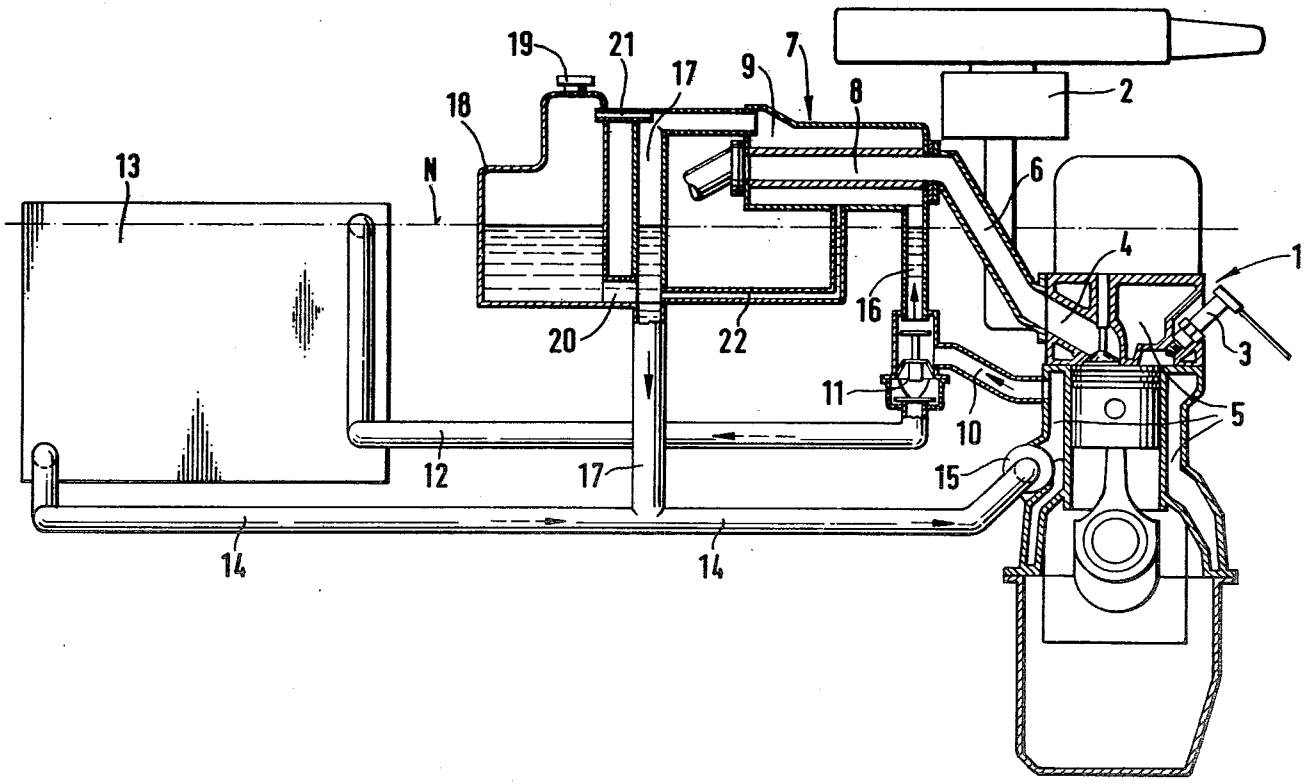
1
2
3
4
5
6
7
8
9
10
11
12
13
14
15
16
17
18
19
20
21
22
M

INTERNAL COMBUSTION ENGINE

BACKGROUND OF THE INVENTION

In the engine of German OS No. 1,916,098 liquid is conducted through a heat exchanger connected to the exhaust system as long as the liquid is below the operating temperature, so that the liquid can absorb heat from the exhaust gases and thereby the warm-up time of the engine is substantially reduced. With rising temperature the liquid is conducted in increasing quantities through the radiator by means of a thermostat mounted in the coolant circuit, so that the operating temperature which is required for the engine is maintained. However, with this arrangement there remains in the heat exchanger a quantity of liquid which now becomes excessively heated and, as a consequence of the connections to the liquid circuit which are open to a greater or lesser extent according to the operating condition, this can have an adverse effect on the circuit and can lead to substantial additional load on the radiator.

SUMMARY OF THE INVENTION

According to the invention, an internal combustion engine is provided having a liquid circuit, a heat exchanger acted on by hot exhaust gases, the heat exchanger being mounted above the normal liquid level of the circuit and in fluid connection with the circuit and a thermostat for controlling the flow of liquid from the circuit through the heat exchanger whereby liquid is conducted through the heat exchanger until a predetermined temperature is reached at which temperature the circuit is cut off from the heat exchanger by the thermostat, and liquid is then no longer present in significant quantities in the heat exchanger.

As the thermostat mounted in the liquid circuit closes off the circuit from the heat exchanger with increasing temperature of the liquid, the liquid level falls until the heat exchanger is completely empty and it falls to the level of the liquid circuit so that there is no further heating of the liquid. In this way any adverse effects on the coolant circuit is avoided, such as for example boiling or undesirably excessive heating of the liquid.

So as to be able to supply the heat exchanger with sufficient liquid when the temperature is below the predetermined operating value, it is proposed that, in an engine with an overflow or expansion tank connected to the liquid circuit, the volume of the overflow tank should be at least equal to the volume of the liquid requirements of the heat exchanger. The availability of an additional supply of liquid provided by the overflow tank avoids the liquid circuit being deprived of the liquid flowing largely through the heat exchanger during the cold and warming-up phases, so that the liquid level in the radiator remains as in the engine.

To obtain complete filling of the heat exchanger during the cold and warming up phases it is furthermore provided that the return connection extends from the upper part of the heat exchanger and that a drain connection is provided at the lowest point of the heat exchanger, this last-mentioned connection having a smaller diameter than the return connection and opening into the return connection below the level of the liquid. After the heat exchanger has been closed off the remaining liquid stemming from the warming up phase is led back into the liquid circuit by means of the drain connection. Moreover, trapped liquid can drain away from the heat exchanger by means of the drain connection as it is not entirely possible to prevent the thermostat allowing a certain quantity of fluid to pass even at higher temperatures, so that any inadvertent refilling of the heat exchanger with liquid is avoided.

This arrangement allows rapid heating-up of the liquid without altering the layout of the circuit and without introducing any adverse overheating of the liquid during running of the engine. The particular advantage of the rapid warm up of liquid lies in the fact that even at low temperatures and during the cold starting phase and also during short runs one can expect a reduction of cold wear, an improvement in exhaust gas quality and a reduction in fuel consumption.

BRIEF DESCRIPTION OF DRAWINGS

An embodiment of the invention, by way of example, is described further in the following with reference to the accompanying drawing in which there is illustrated diagrammatically the general layout of a device according to the invention for heating the liquid circuit of an engine.

DETAILED DESCRIPTION

The illustration shows a liquid cooled internal combustion engine 1, partially in section, in which a combustion process takes place and in which, for this purpose, there are provided an orthodox mixing device 2 with an induction pipe for entry of fresh mixture, an ignition device 3 and an exhaust port 4 for the escape of the burnt gases. The engine 1 furthermore has spaces 5 through which a liquid flows to prevent overheating of the engine as a result of the combustion process. The exhaust port 4 of the engine 1 is connected through an exhaust pipe 6 to a heat exchanger 7 mounted above the normal liquid level N of the overall liquid circuit. The heat exchanger 7 comprises a chamber 8 through which the exhaust gases pass and a chamber 9 arranged around the chamber 8 and connected to the liquid circuit of the engine 1 so that the liquid can pass through the chamber 9.

The liquid circuit of the engine 1 comprises a radiator 13, a suction pump 15, the spaces 5 and a thermostat 11. A pipe 14 connects the lower end of the radiator 13 to the spaces 5. A pipe 10 connects the spaces 5 to the thermostat 11 and a pipe 12 connects the thermostat 11 to the upper end of the radiator. The pump 15 is mounted in the pipe 14 and circulates the liquid in the direction of the arrows. A pipe 16 connects the thermostat 11 to the chamber 9. A return pipe 17 connects the highest point of the chamber 9 to the pipe 14 at a point upstream of the pump 15 and a drain pipe 22, which is of smaller cross-section than the return pipe 17, connects the lowest point of the chamber 9 to the return pipe 17. An overflow or expansion tank 18 provided with a filler cap 19 above the normal liquid level N is connected to the return pipe 17 both at its lower end through a pipe 20 and at its upper end at a point above the normal liquid level N through a balance pipe 21. The volume of the overflow tank 18 is at least equal to the volume of the heat exchanger 7. The drain pipe 22 opens into the return pipe 17 in the region of the pipe 20 at the lower end of the overflow tank 18.

The proposed device for heating up the liquid operates as follows, the drawing shows the engine in its rest condition in which the liquid is at the normal level N and the thermostat closes the flow path to the pipe 12. When the engine 1 starts running the pump 15 simultaneously starts and the liquid leaving the spaces 5 flows in pipe 10 to the thermostat 11 from where it first flows in pipe 16 to the chamber 9 of the heat exchanger 7. The liquid then returns directly to the engine 1 through the return pipe 17 and the pipe 14. In this condition of operation the liquid level N in the return pipe 17 falls as a result of the heat exchanger filling up, and the quantity of liquid necessary to add to this liquid circuit, which corresponds to the volume of the heat exchanger 7 that is above the normal liquid level N, flows from the overflow tank 18 through the pipe 20. In this way the liquid level in the radiator is maintained at the normal level N. The liquid passing through the heat exchanger 7 absorbs heat very rapidly from the chamber 8, heated by the exhaust gases, and the liquid transfers this heat directly to the engine 1 through the closed short circuit path formed by the supply pipe 16, return pipe 17 and pipe 14, and thereby the liquid causes a relatively rapid rise in the operating temperature of the engine. The drain pipe 22 arranged between the heat exchanger 7 and the return pipe 17 or overflow tank 18, because of its small cross-section, only allows the passage of a relatively small quantity of liquid which has no adverse effect on this short-circuit path. As the operating temperature rises the thermostat 11 opens the flow path to the pipe 12, so that part of the liquid leaving the spaces 5 now flows in pipe 12 in the direction of the arrows shown in broken lines, through the radiator 13 and back to the spaces 5 until, when the operating temperature is reached the thermostat 11 closes off completely the flow path to the pipe 16 and the heat exchanger 7 and directs the flow of liquid wholly through the pipe 12.

The reduction and final interruption of the flow of liquid to the heat exchanger 7 causes the heat exchanger 7 to empty itself through the drain pipe 22, so there is no longer any heating of the liquid. Any quantities of liquid that remain or that find their way through the thermostat 11 likewise flow through the drain pipe 22 to the return pipe 17 and so no liquid at all can remain in the heat exchanger 7 and accordingly there is no additional heat applied to the liquid circuit. The emptying of the heat exchanger 7 causes the overflow tank 18 to fill up again to a corresponding extent, till it reaches the liquid level N. The balance pipe 21 has the aim of eliminating any pressure differences arising in the tank 18.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. An internal combustion engine having a cooling liquid circuit comprising a cooling jacket, a radiator and supply and return pipes between the cooling jacket and the radiator, a heat exchanger traversed by an exhaust gas pipe, the heat exchanger being mounted above the liquid level of the circuit, a supply connection connecting said heat exchanger to said supply pipe, a return connection connecting the upper part of said heat exchanger to said return pipe, a drain connecting the lowest point of the heat exchanger to said circuit, and a thermostat valve for controlling the flow of liquid from said supply pipe to said heat exchanger and radiator in such way that when a predetermined temperature of the liquid is reached the supply pipe is cut off from the heat exchanger and connected solely to said radiator.

2. An engine according to claim 1, in which an overflow or expansion tank is connected to the liquid circuit, the volume of the overflow or expansion tank being at least equal to the volume of the liquid of the heat exchanger.

* * * * *